US011186415B2

(12) United States Patent
Shen

(10) Patent No.: US 11,186,415 B2
(45) Date of Patent: Nov. 30, 2021

(54) PRESS-TYPE COSMETIC BOTTLE

(71) Applicant: APR Beauty Group Inc., Toronto (CA)

(72) Inventor: Jun Shen, New Westminster (CA)

(73) Assignee: APR BEAUTY GROUP INC., Toronto (CA)

( * ) Notice: Subject to any disclaimer, the term of this patent is extended or adjusted under 35 U.S.C. 154(b) by 174 days.

(21) Appl. No.: 16/455,101

(22) Filed: Jun. 27, 2019

(65) Prior Publication Data

US 2020/0361674 A1 Nov. 19, 2020

(30) Foreign Application Priority Data

May 14, 2019 (CN) ..... 201920687291.4

(51) Int. Cl.

| | |
|---|---|
| ***B65D 50/04*** | (2006.01) |
| ***A45D 40/00*** | (2006.01) |
| ***A45D 34/00*** | (2006.01) |
| ***A45D 33/24*** | (2006.01) |

(52) U.S. Cl.

CPC ..... *B65D 50/046* (2013.01); *A45D 33/24* (2013.01); *A45D 34/00* (2013.01); *A45D 40/0068* (2013.01)

(58) Field of Classification Search

CPC .... B65D 50/046; B65D 50/045; B65D 50/04; A45D 34/00; A45D 40/222; A45D 33/006

USPC ..... 215/225, 209, 305

See application file for complete search history.

(56) References Cited

U.S. PATENT DOCUMENTS

| | | | | |
|---|---|---|---|---|
| 7,118,298 | B2 | 10/2006 | Tsutsumi | |
| 8,142,093 | B2 | 3/2012 | Vanoncini | |
| 9,375,072 | B2 | 6/2016 | Drugeon et al. | |
| 10,045,600 | B2 | 8/2018 | Apodaca | |
| 10,349,723 | B2 * | 7/2019 | Kim | A45D 33/00 |
| 2016/0068317 | A1 * | 3/2016 | Petit | B65D 50/045 206/438 |
| 2020/0128940 | A1 * | 4/2020 | Lefevre | A45D 40/222 |
| 2020/0205544 | A1 * | 7/2020 | Kim | A45D 34/04 |

* cited by examiner

*Primary Examiner* — Jeffrey R Allen

(57) ABSTRACT

A press-type cosmetic bottle has a bottle body and a bottle cap. The bottle body comprises a bottle base and a bottle interface which are integrated as a whole. The bottle cap comprises an outer cap, a connector connected to the outer cap, and a middle ring fixed on the connector. The outer cap is provided with a press hole, and a press block is provided in the press hole. The bottle interface is held by the middle ring so that the bottle body is tightly connected to the bottle cap, and thus the bottle cap is not easy to get loose under the impact of an external force. The middle ring is configured to be pressed by the press block to make the middle ring deform, so that the middle ring disengages from the bottle interface, thereby removing the bottle cap from the bottle body.

6 Claims, 6 Drawing Sheets

PRESS-TYPE COSMETIC BOTTLE

TECHNICAL FIELD

The present utility model belongs to the technical field of cosmetic bottles, and in particular to a press-type cosmetic bottle.

BACKGROUND ART

Nowadays, female friends prefer to place small bottles of skin care product in their carry-on bags for the convenience of use when being outside. However, since the bottle body placed in a bag is often subjected to impact under an external force from vibration, turning, etc., the bottle cap is easy to get loose from external threads on the bottle mouth, finally causing leakage of the skin care product from the bottle body.

SUMMARY OF THE INVENTION

The present utility model mainly solves the technical problem existing in the prior art described above, and provides a press-type cosmetic bottle.

The above technical problem of the present utility model is mainly solved by the following technical solution: a press-type cosmetic bottle, comprising a bottle body and a bottle cap, wherein the bottle body comprises a bottle base and a bottle interface which are integrated as a whole; the bottle cap comprises an outer cap, a connector and a middle ring, the connector being connected to the outer cap in a clamping manner, and the middle ring being fixed on the connector; the bottle body is connected to the bottle cap by means of the middle ring holding the bottle interface; and the outer cap is provided with a press hole, a press block is provided in the press hole, the press block is in contact with the middle ring, and the middle ring is pressed by the press block to make the middle ring deform, so that by means of the deformation of the middle ring, the middle ring is controlled to hold the bottle interface or disengage from the bottle interface.

Preferably, an outer wall of the connector is provided with an annular clamping block, an inner wall of the outer cap is provided with an annular clamping groove matching the annular clamping block, and the outer cap is connected to the connector by means of the annular clamping block being clamped in the annular clamping groove.

Preferably, the middle ring is elliptical; the middle ring is provided with a first clamping block; the press block, the middle ring and the first clamping block are integrated as a whole, and the press block and the first clamping block are respectively located at two ends of the middle ring; the connector is respectively provided with a sliding groove matching the press block and a first clamping groove matching the first clamping block, and the press block is slidably connected to the sliding groove; the middle ring is connected to the connector by means of the first clamping block being clamped in the first clamping groove; and the connector is provided with an arc plate behind the sliding groove, and the arc plate faces the press block.

Preferably, the middle ring is an elastic body.

Preferably, a top wall of the outer cap is provided with an annular pressure plate; an inner wall of the outer cap is provided with a number of limiting plates on an outer side of the annular pressure plate, the number of limiting plates being circumferentially arranged in an array around the center of the annular pressure plate, and the limiting plates being connected to the annular pressure plate; an upper surface of the middle ring is respectively in contact with the limiting plates and the annular pressure plate; the outer cap is provided with a spacer on an inner side of the annular pressure plate; and an easy-pulling lid is provided under the spacer, and the easy-pulling lid is fastened to cover the bottle interface.

Preferably, a receiving cavity is provided at the center of the bottle body, and a recessed portion recessed inwardly is provided at the center of the bottom of the bottle base.

The present utility model has an advantageous effect in that in the present utility model, the bottle interface is held by the middle ring so that the bottle body is tightly connected to the bottle cap, and thus the bottle cap is not easy to get loose under the impact of an external force, avoiding leakage of a skin care product from the bottle body. In the present utility model, by means of pressing the press block, the middle ring is pressed by the press block to make the middle ring deform, so that the middle ring disengages from the bottle interface, thereby removing the bottle cap. The present utility model is simple in structure, has good practicability and enables mass production.

In the figures: 1. bottle body; 2. bottle cap; 3. bottle base; 4. bottle interface; 5. outer cap; 6. connector; 7. middle ring; 8. press hole; 9. press block; 10. annular clamping block; 11. annular clamping groove; 12. first clamping block; 13. sliding groove; 14. first clamping groove; 15. annular pressure plate; 16. limiting plate; 17. spacer; 18. easy-pulling lid; 19. receiving cavity; 20. recessed portion; and 21. arc plate.

DETAILED DESCRIPTION OF EMBODIMENTS

The technical solution of the present utility model will be further specifically illustrated below by way of an embodiment and in conjunction with the accompanying drawings.

Figure 1:
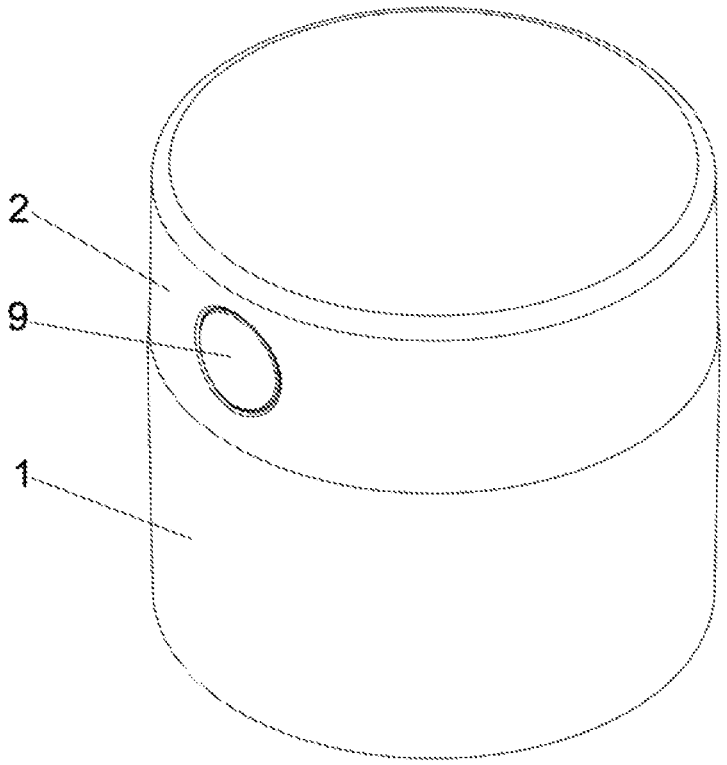
FIG. 1 is a structural schematic diagram of the present utility model.
Figure 2:
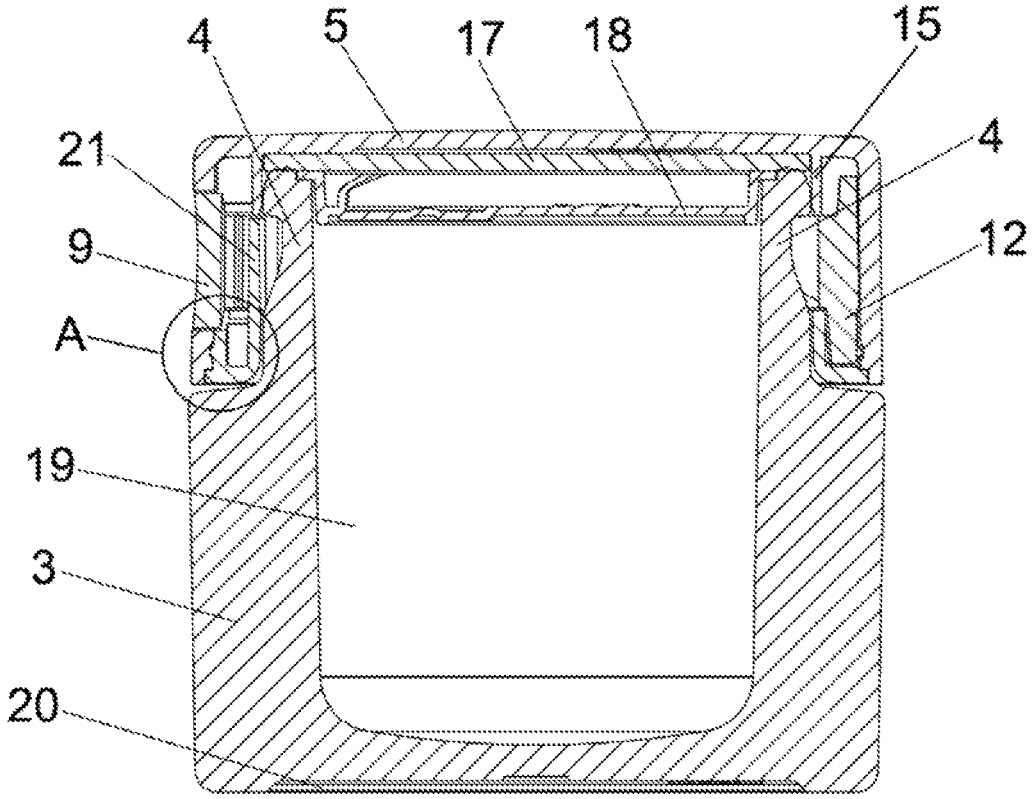
FIG. 2 is a structural cross-sectional schematic diagram of the present utility model.
Figure 3:
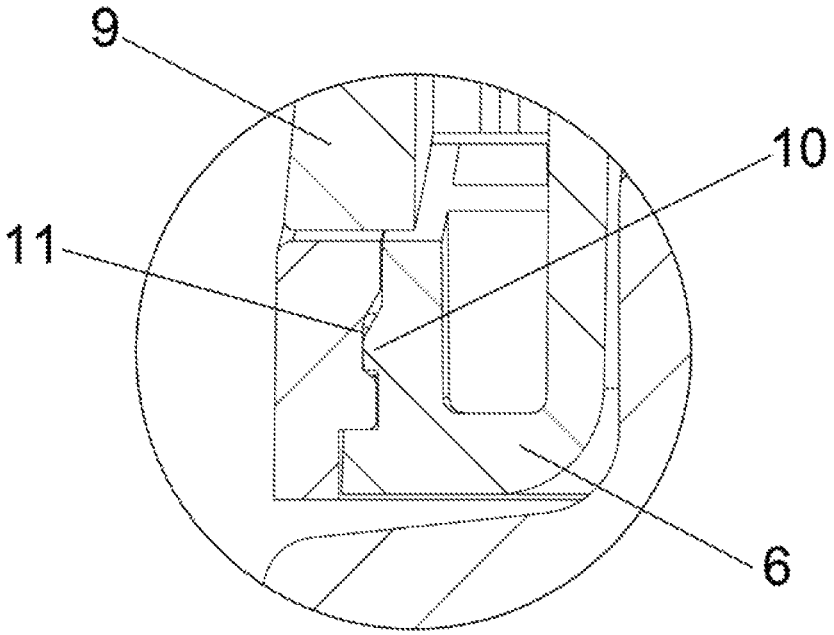
FIG. 3 is an enlarged schematic diagram of a portion A in FIG. 2.
Figure 4:
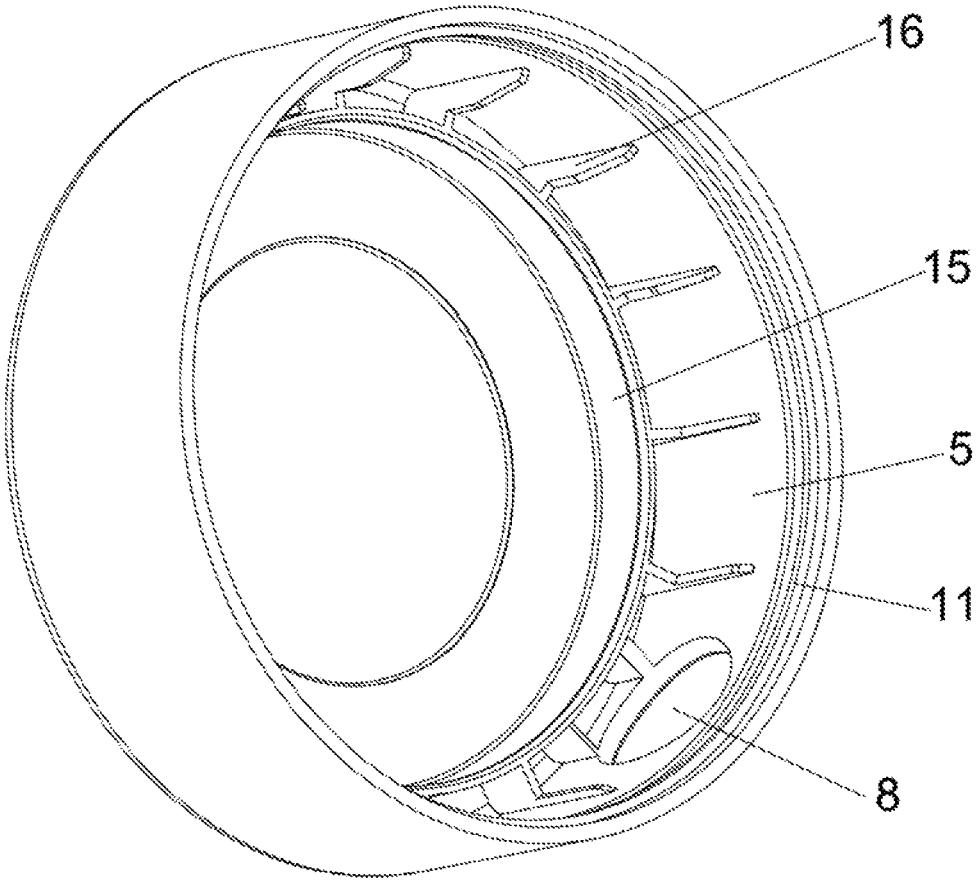
FIG. 4 is a structural schematic diagram of an outer cap of the present utility model.
Figure 5:
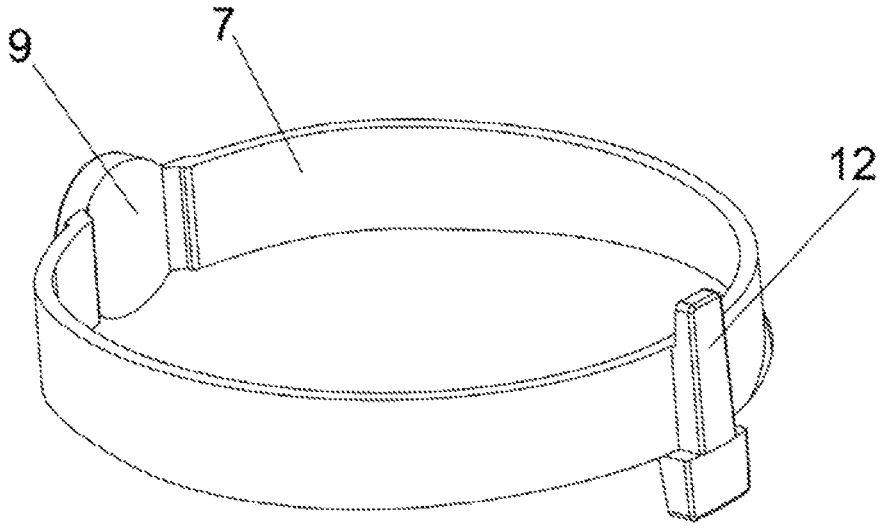
FIG. 5 is a structural schematic diagram of a middle ring of the present utility model.
Figure 6:
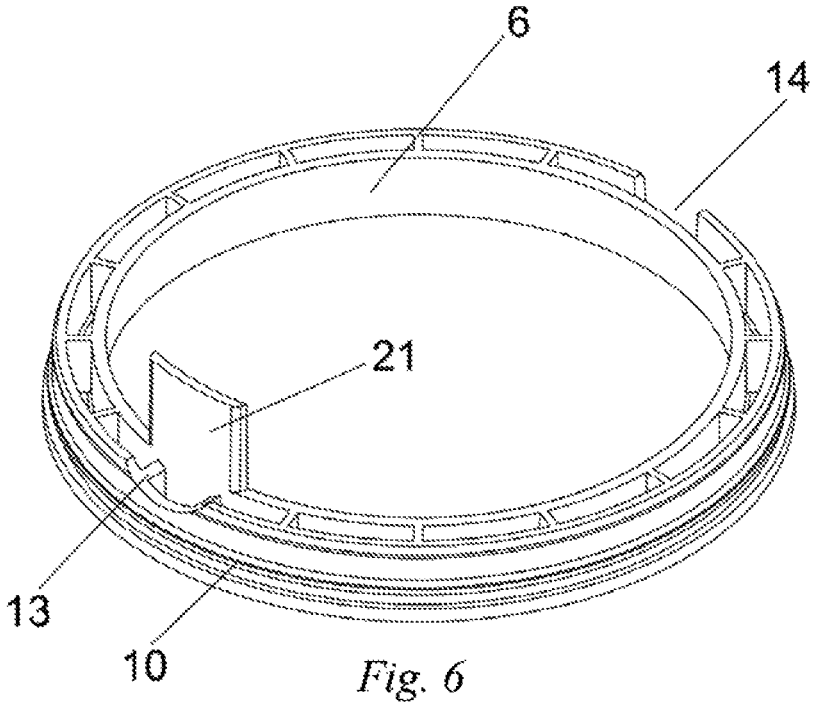
FIG. 6 is a structural schematic diagram of a connector of the present utility model.
Figure 7:
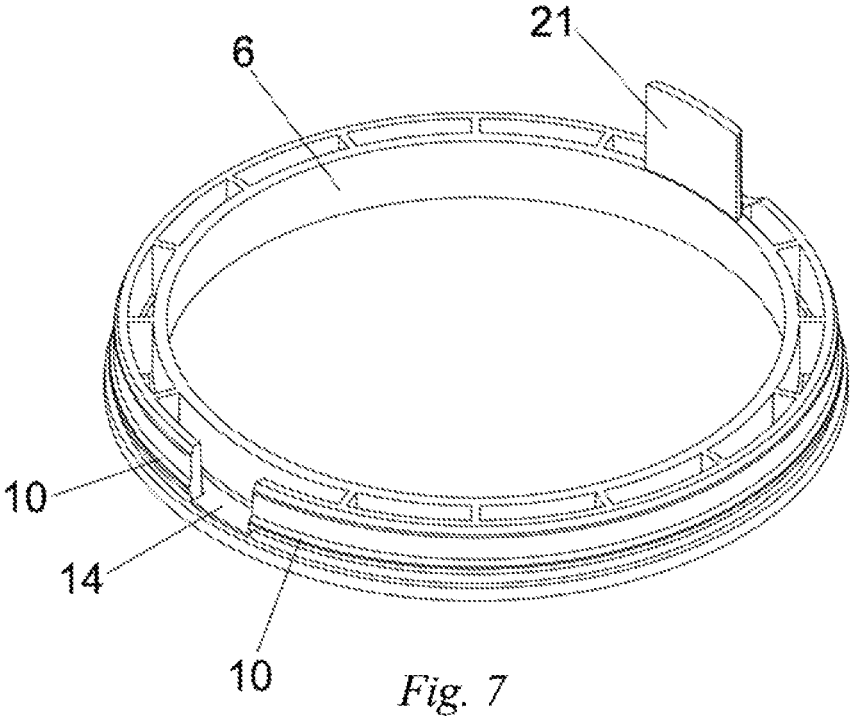
FIG. 7 is a structural schematic diagram, viewed from the rear, of the connector of the present utility model.
Figure 8:
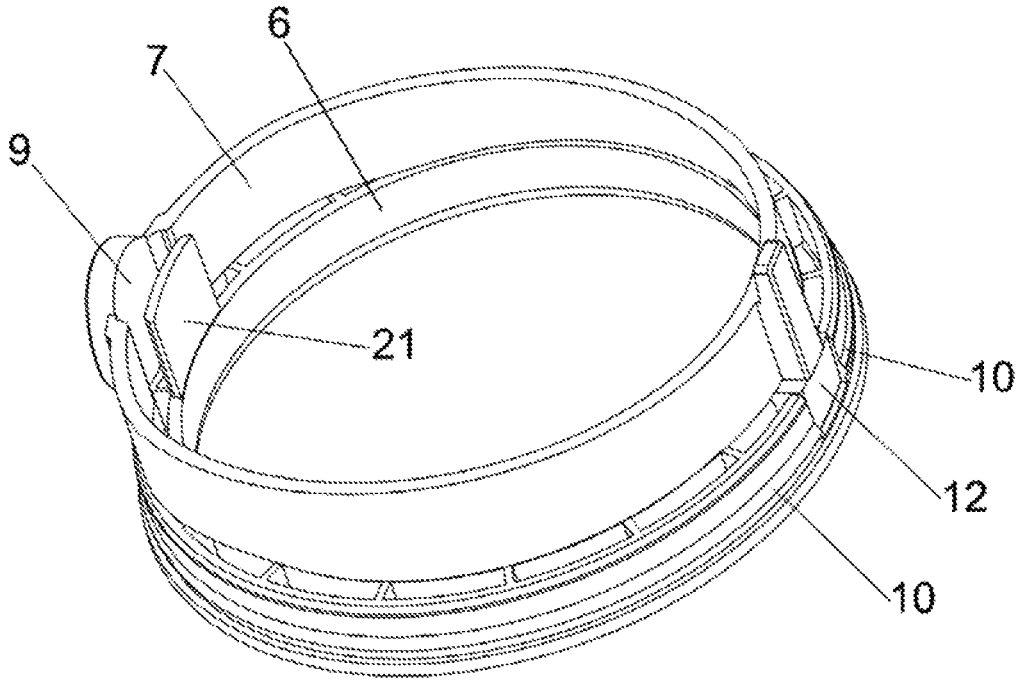
FIG. 8 is a diagram of a connector and a middle ring in a state of use of the present utility model.
Figure 9:
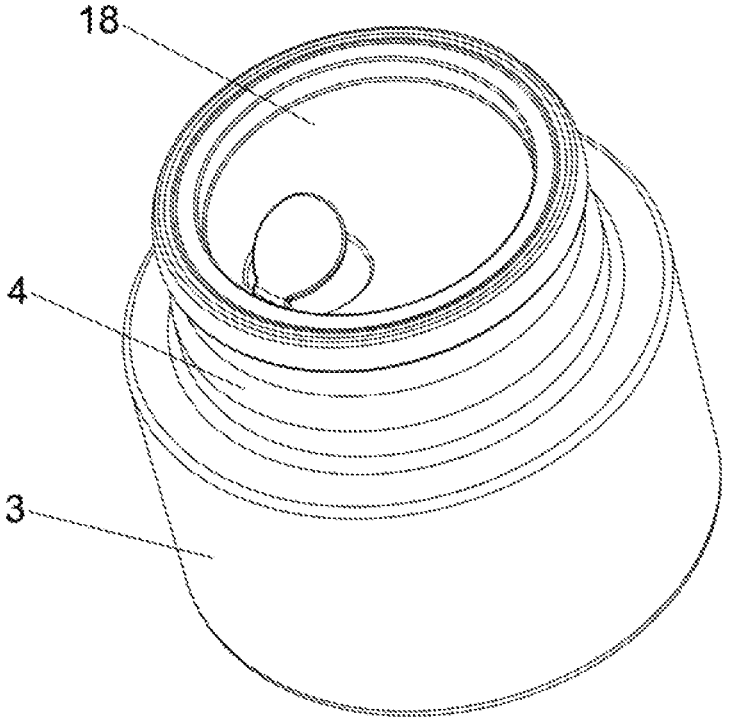
FIG. 9 is a diagram of a bottle body and an easy-pulling lid in a state of use of the present utility model.
Figure 10:
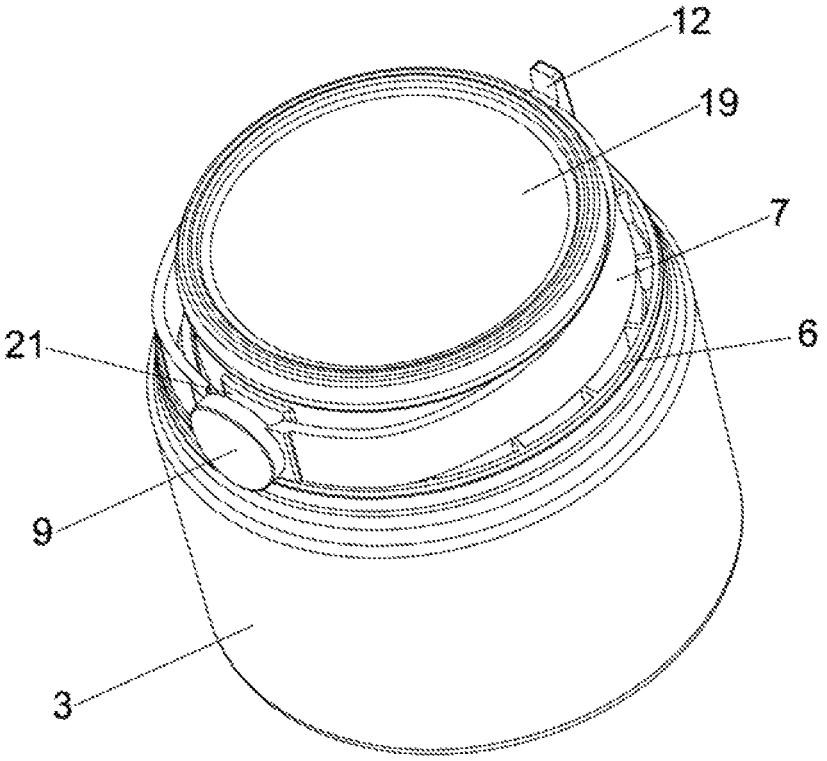
FIG. 10 is a diagram of a bottle interface and a middle ring in a state of use of the present utility model.
Figure 11:
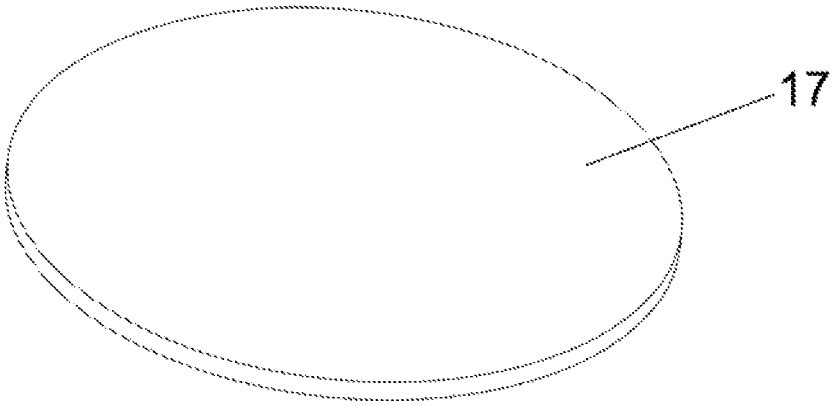
FIG. 11 is a structural schematic diagram of a spacer of the present utility model.

Embodiment: a press-type cosmetic bottle, as shown in FIGS. 1-11, comprises a bottle body 1 and a bottle cap 2, wherein the bottle body 1 comprises a bottle base 3 and a bottle interface 4 which are integrated as a whole; the bottle cap 2 comprises an outer cap 5, a connector 6 and a middle ring 7, the connector 6 being connected to the outer cap 5 in a clamping manner, and the middle ring 7 being fixed on the connector 6; the bottle body 1 is connected to the bottle cap 2 by means of the middle ring 7 holding the bottle interface 4; and the outer cap 5 is provided with a press hole 8, a press block 9 is formed in the press hole 8, the press block 9 is in contact with the middle ring 7, and the middle ring 7 is pressed by the press block 9 to make the middle ring 7 deform, so that by means of deformation of the middle ring 7, the middle ring 7 is controlled to hold the bottle interface 4 or disengage from the bottle interface 4.

An outer wall of the connector 6 is provided with an annular clamping block 10, an inner wall of the outer cap 5 is provided with an annular clamping groove 11 matching the annular clamping block 10, and the outer cap 5 is connected to the connector 6 by means of the annular clamping block 10 being clamped in the annular clamping groove 11.

The middle ring 7 is elliptical; the middle ring 7 is provided with a first clamping block 12; the press block 9, the middle ring 7 and the first clamping block 12 are integrated as a whole, and the press block 9 and the first clamping block 12 are respectively located at two ends of the middle ring 7; the connector 6 is respectively provided with a sliding groove 13 matching the press block 9 and a first clamping groove 14 matching the first clamping block 12, and the press block 9 is slidably connected to the sliding groove 13; the middle ring 7 is connected to the connector 6 by means of the first clamping block 12 being clamped in the first clamping groove 14; and the connector 6 is provided with an arc plate 21 behind the sliding groove 13, and the arc plate 21 faces the press block 9.

The middle ring 7 is an elastic body, the middle ring 7 is pressed by the press block 9 to make the middle ring 7 deform, and when the middle ring 7 is no longer pressed by the press block 9, the middle ring 7 can be restored to its original shape.

A top wall of the outer cap 5 is provided with an annular pressure plate 15; an inner wall of the outer cap 5 is provided with a number of limiting plates 16 on an outer side of the annular pressure plate 15, the number of limiting plates 16 being circumferentially arranged in an array around the center of the annular pressure plate 15, and the limiting plates 16 being connected to the annular pressure plate 15; an upper surface of the middle ring 7 is respectively in contact with the limiting plates 16 and the annular pressure plate 15; by means of the cooperation of the annular pressure plate 15 and the connector 6, the middle ring 7 is clamped and fixed; the limiting plates 16 controls the deformation shape of the middle ring 7 to make the middle ring 7 become circular; the outer cap 5 is provided with a spacer 17 on an inner side of the annular pressure plate 15; and an easy-pulling lid 18 is provided under the spacer 17, and the easy-pulling lid 18 is fastened to cover the bottle interface 4. The easy-pulling lid 18 can seal the bottle body 1, thereby effectively extending the shelf life and the length for preservation of cosmetics and meeting the requirements of transportation and storage. In addition, sealing with the spacer 17 further ensures the leak-tightness.

A receiving cavity 19 is provided at the center of the bottle body 1, and the receiving cavity 19 is used for being filled with the content. A recessed portion 20 recessed inwardly is provided at the center of the bottom of the bottle base 3, and the arrangement of the recessed portion 20 can reduce the material consumption to save on cost without affecting the placement of the bottle body.

When in use, the press block is pressed, the press block slides on the sliding groove and close to the arc plate, the displacement of the press block causes the middle ring to deform, and the middle ring changes from the original elliptical shape to a circular shape matching the bottle interface; and then the bottle body is held, and the bottle cap is pulled outwards, so that the middle ring disengages from the bottle interface, thus the bottle cap is opened.

In summary, in the present utility model, the bottle interface is held by the middle ring so that the bottle body is tightly connected to the bottle cap, and thus the bottle cap is not easy to get loose under the impact of an external force, avoiding leakage of a skin care product from the bottle body. In the present utility model, by means of pressing the press block, the middle ring is pressed by the press block to make the middle ring deform, so that the middle ring disengages from the bottle interface, thereby removing the bottle cap. The present utility model is simple in structure, has good practicability and enables mass production.

Finally, it should be noted that the above embodiment is merely a representative example of the present utility model. Obviously, the present utility model is not limited to the above embodiment, and many variations are possible. Any simple amendments, equivalent variations and modifications made to the above embodiment in accordance with the technical essence of the present utility model are considered to be within the scope of protection of the present utility model.

What is claimed is:

1. A press-type cosmetic bottle, comprising a bottle body and a bottle cap, wherein the bottle body comprises a bottle base and a bottle interface which are integrated as a whole;

wherein the bottle cap comprises an outer cap, a connector and a middle ring;

wherein the connector is connected to the outer cap in a clamping manner;

wherein the middle ring is fixed on the connector;

wherein the bottle body is connected to the bottle cap by means of the middle ring holding the bottle interface;

wherein a press block is in contact with the middle ring;

wherein the outer cap is provided with a press hole, and the press block is provided in the press hole;

wherein the middle ring is elliptical;

wherein the middle ring is provided with a first clamping block and a press block;

wherein the press block, the middle ring and the first clamping block are integrated as a whole;

wherein the press block and the first clamping block are respectively located at two ends of the middle ring;

wherein the connector is provided with a sliding groove matching the press block and a first clamping groove matching the first clamping block;

wherein the press block is slidably connected to the sliding groove;

wherein the middle ring is connected to the connector by means of the first clamping block being clamped in the first clamping groove;

wherein the connector is provided with an arc plate behind the sliding groove;

wherein the arc plate faces the press block; and wherein the middle ring is pressed by the press block to make the middle ring deform, so that by means of the deformation of the middle ring, the middle ring is controlled to hold the bottle interface or disengage from the bottle interface.

2. The press-type cosmetic bottle according to claim 1, wherein an outer wall of the connector is provided with an annular clamping block, an inner wall of the outer cap is provided with an annular clamping groove matching the annular clamping block, and the outer cap is connected to the connector by means of the annular clamping block being clamped in the annular clamping groove.

3. The press-type cosmetic bottle according to claim 1, wherein the middle ring is an elastic body.

4. The press-type cosmetic bottle according to claim 1, wherein a top wall of the outer cap is provided with an annular pressure plate; an inner wall of the outer cap is provided with a number of limiting plates on an outer side of the annular pressure plate, the number of limiting plates being circumferentially arranged in an array around the center of the annular pressure plate, and the limiting plates being connected to the annular pressure plate; an upper surface of the middle ring is respectively in contact with the limiting plates and the annular pressure plate; the outer cap is provided with a spacer on an inner side of the annular pressure plate; and an easy-pulling lid is provided under the spacer, and the easy-pulling lid is fastened to cover the bottle interface.

5. The press-type cosmetic bottle according to claim 1, wherein a receiving cavity is provided at the center of the bottle body, and a recessed portion recessed inwardly is provided at the center of the bottom of the bottle base.

6. The press-type cosmetic bottle according to claim 1, wherein the middle ring is an elastic body.

* * * * *